United States Patent [19]

Simpson et al.

[11] 4,375,848

[45] Mar. 8, 1983

[54] STACKED PANEL PACKAGE AND METHODS FOR MAKING SAME

[75] Inventors: Harold G. Simpson, Oklahoma City; Robert S. Wilson, Del City, both of Okla.

[73] Assignee: The Wickes Corporation, San Diego, Calif.

[21] Appl. No.: 214,486

[22] Filed: Dec. 9, 1980

[51] Int. Cl.[3] ..... B65D 85/62; B65B 35/52

[52] U.S. Cl. ..... 206/321; 206/503; 206/507; 206/509; 53/447; 52/519; 211/495; 414/30; 428/141; 428/161

[58] Field of Search ..... 414/30, 42, 35, 97; 53/447; 206/449, 451, 503, 515, 516, 518, 505, 507, 508, 509, 511, 519, 321, 323, 821, 499; 211/495, 50; 428/141, 161, 162; 52/529, 530, 531, 542, 519

[56] References Cited

U.S. PATENT DOCUMENTS

| | | | |
|---|---|---|---|
| 217,748 | 7/1879 | Russell et al. | 206/323 X |
| 1,405,825 | 2/1922 | Flannery | 206/45.14 X |
| 1,498,555 | 6/1924 | Langan | 206/323 |
| 3,415,367 | 12/1968 | Lynch | 206/321 |

*Primary Examiner*—Steven M. Pollard
*Assistant Examiner*—B. Gehman
*Attorney, Agent, or Firm*—Learman & McCulloch

[57] ABSTRACT

Rectangular panels, such as standing seam roof panels, which have upstanding flanges or seam sections extending along two opposed longitudinal side edges are stacked in a nested relationship. Each panel in the stack is transversely bowed about its longitudinal axis to spread the upper edges of the upstanding flanges or seam sections apart by a distance sufficient to permit the next uppermost panel to be nested between the flanges or seam sections of the lower panel. A longitudinal support member is located under the longitudinal centerline of the lowermost panel of the stack to support that panel in its bowed position. The support member and panel stack are in turn supported on a rigid, flat support base, and straps passing transversely around the support base and panel stack bind these elements into a unitary package for shipping or storage.

6 Claims, 7 Drawing Figures

STACKED PANEL PACKAGE AND METHODS FOR MAKING SAME

BACKGROUND OF THE INVENTION

In a commonly owned copending application filed by Harold G. Simpson, Ser. No. 183,717, filed Sept. 3, 1980, and entitled Roof Panel Assemblies for Forming Weather-Proof Standing Seam Joints and the like and Methods of Joining Standing Seam Roof Panels, there is disclosed a standing seam roof panel employed as a modular element in the construction of metal roofs for buildings. This particular panel is of an elongate rectangular shape, and is formed from sheet metal material to have upstanding longitudinal seam sections which extend the entire length of the two opposed longitudinal sides of the panel. The outermost sides of these seam sections include a generally vertical outwardly facing wall which, in the assembly of a roof, is clamped in opposed face-to-face relationship with the corresponding wall on the seam section of the next adjacent panel.

Because the vertical wall portion of the standing seam section has a finite transverse thickness—in the specific panel referred to above, the vertical wall actually is bent inwardly into an inverted U-shaped transverse cross-section—the panels cannot be conveniently stacked on top of each other because the vertical wall portions of one panel will rest upon the vertical portions of the next lowermost panel in the stack with all remaining portions of the two panels being out of contact with each other. A stack so formed is not particularly stable, because it requires only a slight misalignment of two panels to cause one side of the upper panel to slip inwardly of the relatively narrow transverse extent of the wall of the next lowermost panel and thus drop into a tilted position which will topple that portion of the stack above the tilted panel.

The present invention is especially devised to provide a stable stack configuration for panels of this general type and to provide a simple and efficient method for assembling the panels into such a stack for packaging.

SUMMARY OF THE INVENTION

To assemble panels of the type described above into a stable stack, the panel which will constitute the lowermost panel of the stack is located upon a flat supporting surface and flexed transversely about its longitudinal centerline to cause the normally flat central portion of the panel to bow upwardly so that its transverse cross-section is that of an upwardly convex arc. Upward bowing of the central portion of the panel in this manner causes the upper edges of the standing seam sections to spread apart from each other so that the standing seam portions of a second panel can then be lowered between and into nested relationship with the spread-apart seam portions of the lower of the two panels. The second panel in the stack is then bowed in the same fashion and the process is repeated with successive panels.

Bowing of the panels may be accomplished either by placing a support member of the desired height upon the flat support surface and resting the longitudinal centerline of the lowermost panel of the stack upon this support member, or by drawing the upper edges of the seam portions of the panel outwardly away from each other, or by a combination of these two methods.

To form such a stack into a unitary package, a flat rigid support base is utilized as the surface upon which the stack is formed, and the assembled stack of panels is bound to the support base by strapping which extends transversely around the stack and base.

Other objects and features of the invention will become apparent by reference to the following specification and to the drawings.

IN THE DRAWINGS

Figure 1:
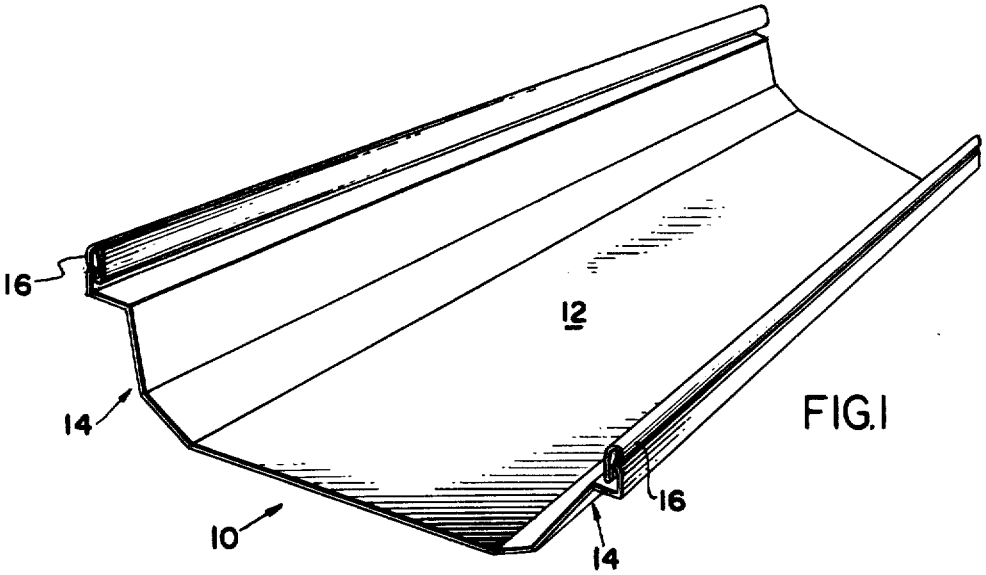
FIG. 1 is a perspective view of a standing seam roof panel.

Referring to FIG. 1, there is shown a perspective view of a standing seam roof panel designated generally 10, which is of the type shown and described in detail in the aforementioned pending application, (which I incorporate herein by reference). For purposes of the present application, the preferably sheet metal panel 10 may be formed, by well-known roll forming techniques into the cross-sectional configuration shown in FIG. 1 which includes a rectangular flat main portion 12 and standing seam sections 14 projecting upwardly from the opposite longitudinal side edges of main section 12. The outer and uppermost portions of seam section 14 consist of a generally vertically disposed wall 16, which, in this particular panel, is of an inverted generally U-shaped transverse cross-section.

Figure 2:
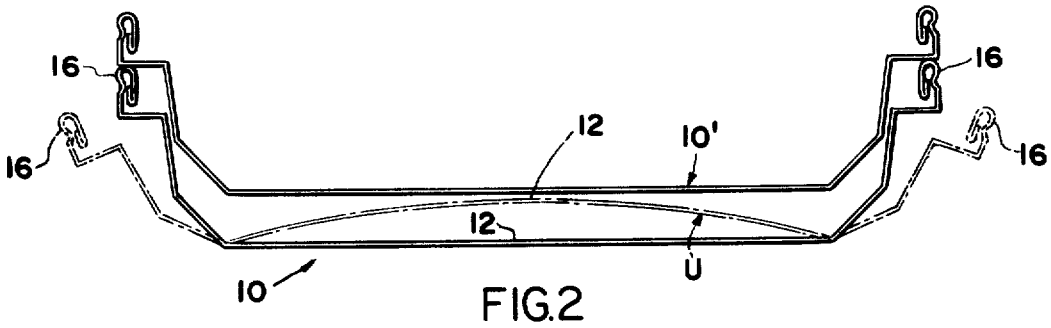
FIG. 2 is an end elevational view of the panel of FIG. 1, showing the panel in a bowed position in broken lines.

Referring now to FIG. 2, the panel 10 of FIG. 1 is shown in end view in full line in its normal configuration. A second panel 10' is shown supported on the lower panel. It is believed apparent from this figure that the upper of the two panels, 10', is supported only on the upper edges of the walls 16 of the lower panel, and that only a slight displacement of the upper panel 10' to the right or to the left of the position shown in FIG. 2 would cause one side of the panel 10' to slip downwardly along the inner side of one of the walls 16 of the lower panel into a tilted position. It is further believed apparent that if any substantial number of panels were stacked in the fashion indicated in full line in FIG. 2, substantially the entire weight of such a stack would be concentrated on the top of the walls 16 of the lower panel.

Also depicted in FIG. 2 is a broken line showing the lower panel 10 flexed into a position in which the central portion 12 of the panel is bowed upwardly. It will be noted that bowing of the central portion of the panel causes the upper portions of the seam sections represented by walls 16 to transversely spread apart to a spacing such as to exceed that between the outer sides of opposed walls 16 of a panel in its normal position.

Figure 3A:
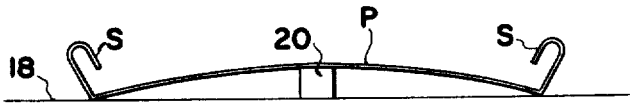
FIGS. 3A and 3B are schematic diagrams illustrating alternative methods for bowing a panel.
Figure 3B:
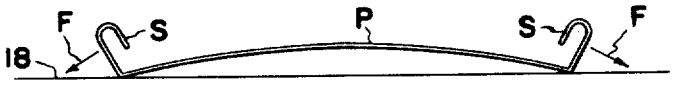

In FIGS. 3A and 3B, two methods for flexing a panel generally similar to that shown in FIGS. 1 and 2 into the bowed position are illustrated. For purposes of simplification, the cross-section of the panel of FIGS. 1 and 2 has been simplified in FIGS. 3A, 3B and 4 with the main portion of the similating panel of these three latter figures identified at P corresponding to that of main section 12 of the panel of FIGS. 1 and 2, and the standing seam sections 14 and walls 16 being schematically represented at S.

In FIG. 3A, a support member 20 is located on a flat surface 18, to underlie the longitudinal centerline of the panel main section P. The flexibility of the similating panel of FIG. 3A (and of FIGS. 1 and 2) such that, when so supported upon member 20, the panel will assume the bowed position shown in FIG. 3A under the action of gravity, and when panel P is so placed on support member 20, its two opposite longitudinal side edges will simply fall, by virture of the weight of the panel, until they rest on support surface 18 as shown in FIG. 3A.

In FIG. 3B, the central portion of the similating panel P is similarly bowed by applying outwardly directed forces indicated at vectors F to the upper portions of the standing seam S.

Figure 4:
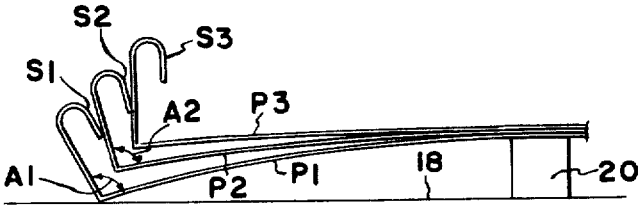
FIG. 4 is a schematic diagram illustrating three panels in stacked relationship in accordance with the present invention.

In FIG. 4, three panels similar to those shown in FIGS. 3A and 3B are schematically shown in half section in a stacked relationship. FIG. 4A is a corresponding view of the panels of FIG. 1 in a stack.

In FIG. 4, it will be assumed that the lowermost panel P1 was bowed, by gravity, in the manner described in connection with the description of the FIG. 3 above. A second panel P2 is then lowered into position upon panel P1 and, because of the flexibility of the panel, when the central portion of panel P2 becomes supported by the central portion panel P1, the sides of panel P2 will begin to bow downwardly under gravity and continue to bow downwardly until the side seam portion S2 of panel P2 engages the side seam portion S1 of panel P1. Note that the radius of curvature of the bowed arc assumed by panel P2 is greater than the corresponding radius of curvature of the bowed lower panel P1. Stated in another way, panel P2 is bowed less than panel P1. Because the angle A1 between the main portion of panel P1 and seam section S1 is (substantially) the same as the corresponding angle A2 between sections P2 and S2 of the second panel, it necessarily follows, as indicated in FIG. 4, that the transverse spacing between the inner side of seam sections S2 of the second panel is less than the corresponding spacing between seam sections S1 of the lower panel. However, in the arrangement of FIG. 4, sufficient spacing exists between the opposed seam sections S2 of the second panel to enable a third panel P3 to be inserted into nested stacked relationship as shown in FIG. 4.

FIG. 4 indicates schematically the limitations of the stacking technique of the present invention. The lowermost panel in the stack is flexed into a maximum bowed condition—that is the radius of curvature of the bowing is a minimum, compared to any other panel in the stack. Bowing of the lowermost panel in the stack preferably is limited to a curvature such that the elastic limit of the panel, determined by its material and dimensions, is not substantially exceeded so that no undesired deformation of the panel results from the bowing process.

This limitation on the maximum curvature which the lowermost panel assumes correspondingly limits the maximum spacing which can be achieved between the opposed side seam sections S1 of the lowermost panel. Because this transverse spacing decreases step-by-step for each panel added to the top of the stack, eventually the spacing between the opposed side seam sections S of the uppermost panel will be reduced to a distance such that an additional panel cannot be added.

While the stacking sequence schematically illustrated in FIG. 4 assumes the bowing of the panels to be accomplished by the use of an underlying support member 20 as in the methods schematically illustrated in FIG. 3A, a similar stack may be formed by the method schematically indicated in FIG. 3B. In this latter case, the lowermost panel is simply placed flat upon the support surface 18 and the upper portions of the side seams S are drawn apart, this action bowing the central portion of the panel upwardly, to a distance just sufficient to permit a second panel to be dropped between the spread-apart seam portions. The seam portions of the second panel are then similarly drawn apart by a distance just sufficient to permit a third panel to be dropped between the spread-apart seam portions of the second panel. The spreading of the seam portion of the second panel will cause an increase in the spacing between the seam sections of the first or lowermost panel in the stack, thus increasing its radius of curvature or degree of bowing. This latter technique may be found more convenient in those cases where the panel is less flexible.

A combination of the methods of FIGS. 3A and 3B by starting the stack upon support member 20 as in FIG. 3a, and augmenting the gravitational flexing by the application of force as in FIG. 3B.

Figure 5:
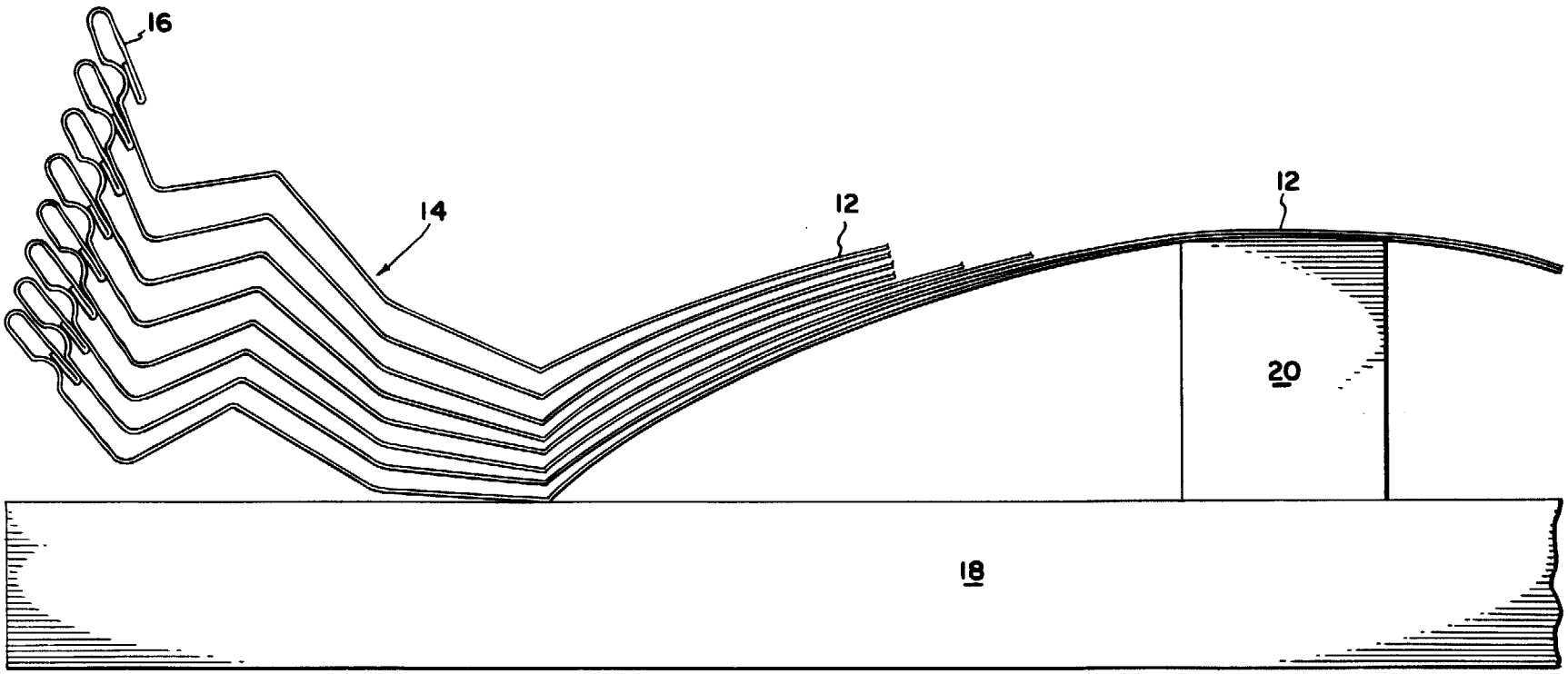
FIG. 5 is a view similar to FIG. 4 showing a stack formed of the panels of FIG. 1.
Figure 6:
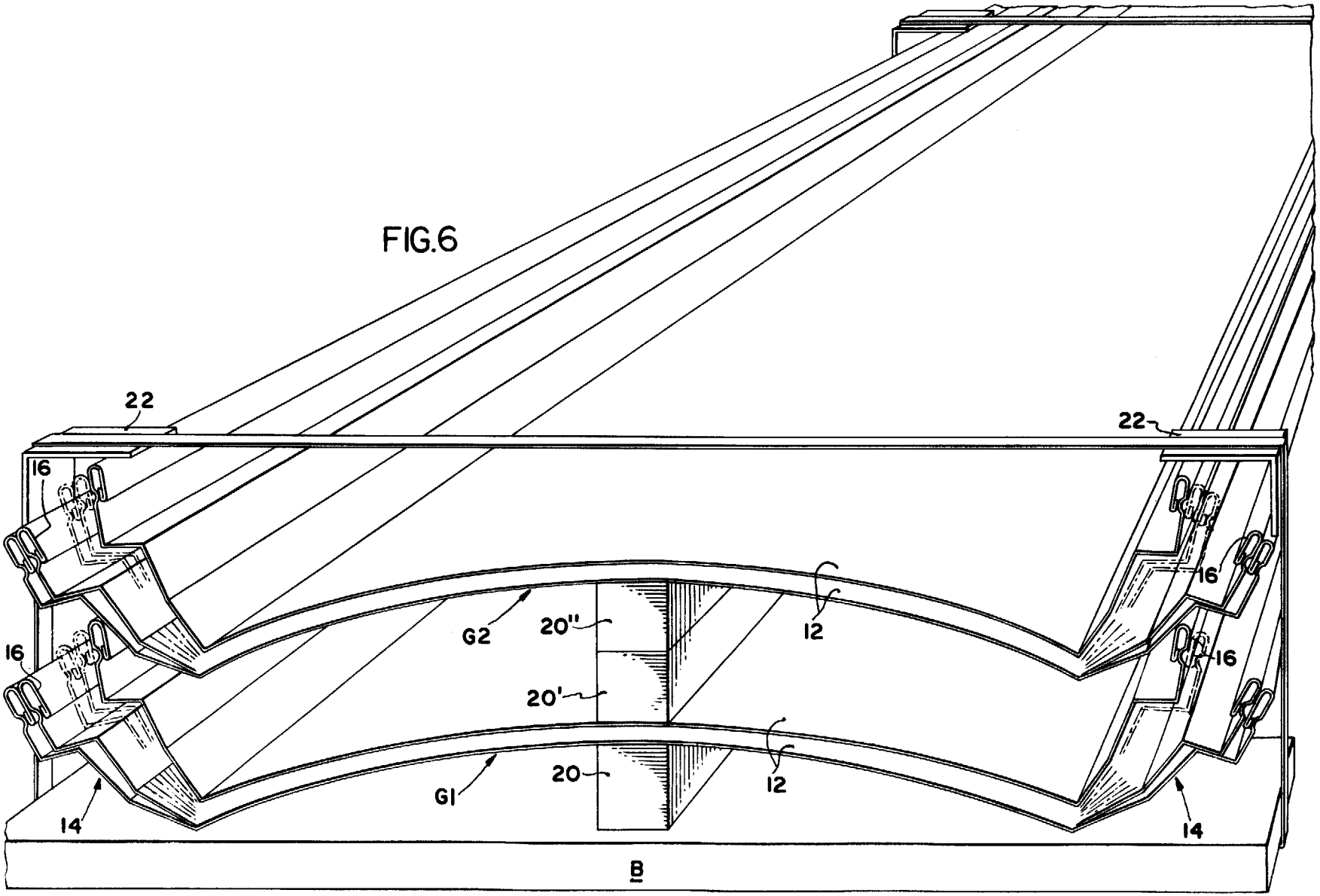
FIG. 6 is a perspective view of a package of panels of the type shown in FIG. 1, stacked in accordance with the present invention.

In FIG. 5, there is shown a perspective view of an assembled package of standing seam roof panels of the type shown in FIGS. 1 and 2 which have been assembled by either of the techniques described. The dimensions of these particular panels, which typically are formed of 24 gauge material, is such that twenty panels is about the maximum number which can be assembled into a single stack, bearing in mind the limitations discussed previously. In the package shown in FIG. 5, the panels are stacked in two groups G1 and G2, each group consisting of aboaut twenty panels, typically 24 inches wide and 20 feet to 41½ feet in length.

The package of FIG. 5 includes a flat rigid support base B, either continuously or intermittently, such as a wood sheet or pallet, and this base B will function as the support surface during the formation of the lower group G1 of the package of FIG. 5. A support member 20 is shown underlying the longitudinal centerline of the panels of the lower group G1, such a support member is preferably employed in the package, regardless of whether the stack of the lower group G1 of panels is formed by the technique of FIG. 3A or that of FIG. 3B. If the technique of FIG. 3A is employed, the lower support member 20 is inserted before the stack is formed; if the technique of FIG. 3B is used, the support member 20 is inserted after the stack is formed.

In the package of FIG. 5, two support members 20' and 20'' are employed to separate the two stacks of groups G1 and G2 so that the two groups lightly contact each other. Strapping S extending transversely around the panels and support base B firmly binds the elements together into the package shown in FIG. 5. Preferably, a right angled pad member, such as a piece of cardboard or the like, is disposed over the seam sections of the uppermost group G2 to prevent the strap from directly contacting the seam sections.

While alternative methods and stack formations have been described in detail, it will be apparent to those skilled in the art that the methods and stacks disclosed may be modified. Therefore, the foregoing description is to be considered exemplary rather than limiting, and the true scope of the invention is that defined in the following claims.

We claim:

1. A method of stacking a plurality of like, generally rectangular standing seam panels of sheet material, each panel having a substantially flat main portion and a pair of upstanding seam edge portions projecting upwardly from said main portion along the two longitudinal side edges of the main portion; said method comprising the steps of flexing a first of said panels about its longitudinal centerline to elevate said centerline relative to said longitudinal side edges and to bow the main portion of the panel into a configuration such that the transverse cross-section of the panel at any longitudinal position is that of an upwardly convex arc having a minimum radius of curvature such that the elastic limit of the panel material is not exceeded, flexing a second of said panels into an upwardly bowed configuration similar to that of the bowed first panel wherein the minimum radius of curvature of the bowed portion of the flexed second panel exceeds that of the flexed first panel, and stacking the flexed second panel upon said first panel with the seam edge portions of the second panel nested within the seam edge portions of the first panel.

2. A method of stacking a plurality of like generally rectangular standing seam panels of sheet material, each panel having a substantially flat main portion and upstanding seam edge portions projecting upwardly from said main portion along each of the two longitudinal side edges of the main portion, said method comprising the steps of flexing a first of said panels about its longitudinal axis to cause said main portion to bow upwardly and to spread the upper edges of said seam edge portions transversely outwardly a distance sufficient to enable a second of said panels to pass downwardly between the spread upper edges of said first panel with the seam portions of said second panel into nested relationship between the spread seam portions of said first panel, and lowering a second of said panels into the last mentioned position.

3. The method defined in either of claims 1 and 2 wherein the step of flexing said first panel comprises the step of placing an elongate support member of predetermined thickness upon a flat surface and placing said first panel upon said support member with the longitudinal centerline of said first panel aligned with the longitudinal centerline of said support member.

4. The method defined in either of claims 1 and 2 wherein the step of flexing said first panel comprises the step of applying a transversely outwardly directed force to the upper portions of each of said seam portions.

5. A method of stacking a plurality of like generally rectangular standing seam panels of sheet material, each panel having a substantially flat main portion and integral generally vertically extending seam edge portions projecting from said main portion along the two longitudinal side edges of the main portions to terminate at longitudinally extending free edges vertically displaced from said main portion, said method comprising the steps of flexing a first of said panels about its longitudinal axis to bow the the main portion of the panel and to spread the free longitudinal edges of said seam edge portions transversely outwardly a distance sufficient to enable a second of said panels to be located between the spread free edges of said first panel with the seam portions of said second panel into nested relationship between the spread seam portions of said first panel, and locating a second of said panels into the last mentioned position.

6. An assembled stack of standing seam panels, each of said panels comprising a generally rectangular normally substantially flat main portion and standing seam edge portions projecting upwardly from the two longitudinal side edges of said main portions, said stack comprising a flat support base, and elongate support member located on said base, a stack of said panels, the lowermost panel of said stack being supported along the longitudinal centerline of its main portion upon said support member with said two longitudinal side edges resting upon said support base whereby the main portion of said lowermost panel is arcuately bowed upwardly in its tranverse extent, successive panels in said stack having their main portions bowed in successively increasing radii of curvature, each of said successive panels having its seam edge portions nested between the seam edge portions of the next lowermost panel in the stack, and strap means extending transversely around said support base and said stack to bind said panels, support member and support base together.

* * * * *